US008210188B2

(12) United States Patent
Wilcox et al.

(10) Patent No.: US 8,210,188 B2
(45) Date of Patent: Jul. 3, 2012

(54) DISHWASHER WITH DISPENSING SYSTEM

(75) Inventors: Christopher Carl Wilcox, Stevensville, MI (US); Brent Allen Deweerd, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 565 days.

(21) Appl. No.: 12/030,237

(22) Filed: Feb. 13, 2008

(65) Prior Publication Data

US 2009/0199881 A1 Aug. 13, 2009

(51) Int. Cl.
*B08B 3/00* (2006.01)

(52) U.S. Cl. ..... 134/99.2

(58) Field of Classification Search ..... 134/99.2
See application file for complete search history.

(56) References Cited

U.S. PATENT DOCUMENTS

| | | | | |
|---|---|---|---|---|
| 3,827,600 | A | 8/1974 | Janke | |
| 5,176,297 | A * | 1/1993 | Mooney et al. | 222/325 |
| 5,261,432 | A | 11/1993 | Sandrin | |
| 5,413,259 | A | 5/1995 | Cerruti et al. | |
| 5,839,454 | A * | 11/1998 | Matz | 134/57 D |
| 6,138,693 | A | 10/2000 | Matz | |
| 6,327,729 | B1 | 12/2001 | Wunderlich et al. | |
| 7,047,987 | B2 * | 5/2006 | Cerruti et al. | 134/58 D |
| 2004/0231710 | A1 * | 11/2004 | Dingler et al. | 134/93 |
| 2005/0000551 | A1 | 1/2005 | McIntyre et al. | |
| 2005/0126607 | A1 * | 6/2005 | Haft et al. | 134/56 D |
| 2009/0235962 | A1 * | 9/2009 | Classen et al. | 134/57 D |

FOREIGN PATENT DOCUMENTS

| | | | |
|---|---|---|---|
| DE | 3833961 | A * | 4/1990 |
| EP | 0430366 | A1 | 6/1991 |
| EP | 0611843 | A1 | 8/1994 |
| EP | 0691101 | A1 | 1/1996 |
| EP | 691101 | A1 * | 1/1996 |
| FR | 2593697 | A1 | 8/1987 |
| WO | WO 2007128698 | A1 * | 11/2007 |

OTHER PUBLICATIONS

DE 38 33 961 Machine Translation.*
DE 38 33 961 English Translation.*
DE 38 33 961 Machine Translation Apr. 1990 Germany Stamminger et al.*
DE 38 33 961 English Translation Apr. 1990 Germany Stamminger et al.*

* cited by examiner

*Primary Examiner* — Michael Barr
*Assistant Examiner* — Charles W Kling
(74) *Attorney, Agent, or Firm* — Robert A. Bacon; McGarry Bair PC

(57) ABSTRACT

A dishwasher with both a single use dispenser and a bulk dispenser, where wash aid can be selectively dispensed into a wash chamber of the dishwasher directly from the single use dispenser or indirectly from the bulk dispenser through the single use dispenser.

17 Claims, 2 Drawing Sheets

DISHWASHER WITH DISPENSING SYSTEM

BACKGROUND OF THE INVENTION

Dishwashers are a common convenience appliance in many households. A user simply loads the dishwasher with dishes, utensils, and other wares to be cleaned into a wash chamber, along with an optional supply of a wash aid, such as a detergent, pre-wash detergent, rinse aid, bleach, etc., and selects and initiates a cleaning cycle that is subsequently automatically carried out by the dishwasher. An example of a typical cleaning cycle includes the steps of washing the wares with heated liquid and optional wash aid and rinsing the wares with heated liquid.

Dishwashers are often provided with a dispenser for automatically dispensing one or more wash aids at an appropriate time during a cleaning cycle. The wash aid mixes with fluid, such as water, to produce a cleaning fluid for circulation through the wash chamber. One common type of dispenser is the manual or single use dispenser, which can be filled with only enough wash aid for a single cleaning cycle. These single use dispensers are to be filled with wash aid by a user prior to each cleaning cycle of the dishwasher, which is a tedious task that many users would prefer not to perform. Also, users may provide too much or too little wash aid for the given cycle, which may negatively impact the cleaning result. Bulk dispensing is one solution that improves the ease of supplying wash aid to the dishwasher for the user. However, there are many limitations to today's bulk dispensers, including the lack of user-control over the amount of wash aid dispensed and the inability for users to still selectively use a single use dispenser.

SUMMARY OF THE INVENTION

A dishwasher according to one aspect of the invention comprises a housing defining a wash chamber having an open face, a door movably mounted to the housing for movement between an open position and a closed position for selectively closing the open face and a dispensing system carried by the door, the dispensing system comprising a single use dispenser configured to store a single dose of wash aid and a bulk dispenser configured to store multiple doses of wash aid and fluidly coupled to the single use dispenser to dispense wash aid through the single use dispenser, wherein a wash aid may be dispensed into the wash chamber directly from the single use dispenser or indirectly from the bulk dispenser through the single use dispenser.

DESCRIPTION OF THE PREFERRED EMBODIMENT

Figure 1:
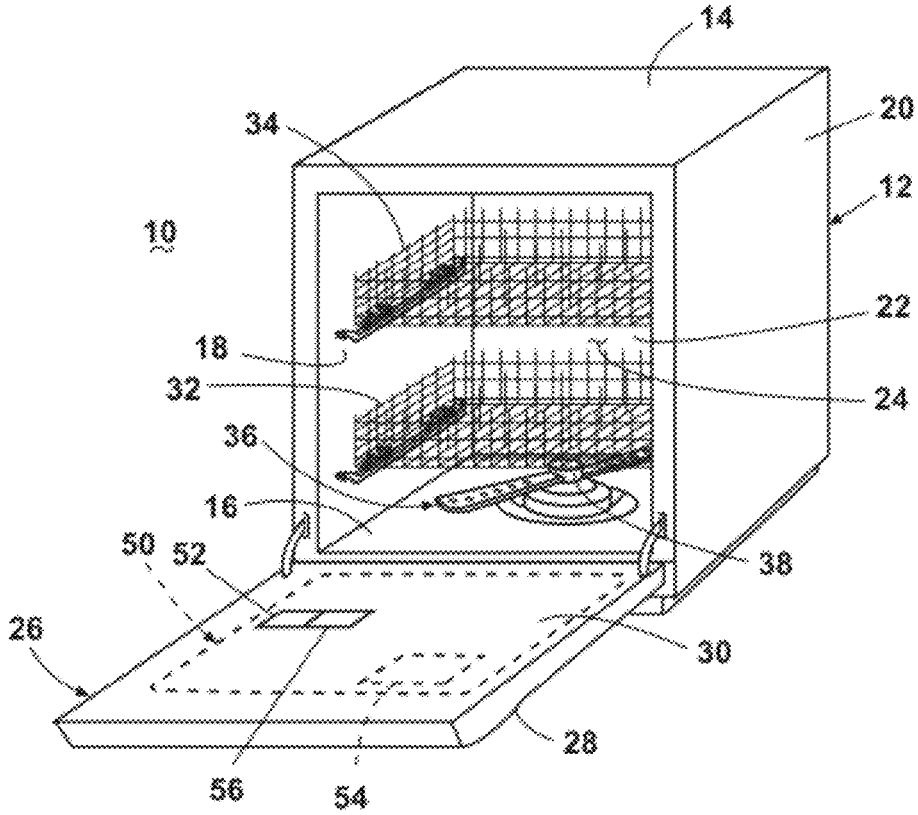
FIG. 1 is a schematic illustration of a dishwasher comprising a dispensing system according to an embodiment of the present invention comprising a door mounted to a housing and carrying the dispensing system.

Referring to FIG. 1, a household dishwasher 10 comprising a dispensing system 50 according to the invention is schemicatically illustrated. The dishwasher 10 includes an exterior housing 12 having spaced upper and lower walls 14, 16 joined by opposing side walls 18, 20 and a rear wall 22 to form an open-faced wash chamber 24. A door 26 is movably mounted to the cabinet 12 between an open position, as shown in FIG. 1, wherein the user can access the wash chamber 24, and a closed position, wherein the door 26 closes the open face of the wash chamber 24 in a conventional fashion. The door 26 comprises an outer panel 28 and an inner panel 30 which faces the wash chamber 24 when the door 26 in the closed position.

The dishwasher 10 may further comprise one or more utensil racks commonly utilized in household dishwashers for holding various utensils, such as plates, bowls, beverage containers and any other items that might be placed into a dishwasher for cleaning, including those items listed above. As illustrated, the dishwasher 10 comprises a lower, first utensil rack 32 and a higher, second utensil rack 34 slidably mounted to the side walls 18, 20 of the housing 12. It should also be noted that the upper and lower utensil racks 32, 34 shown are examples, and other sizes, shapes, and quantities of baskets may be utilized.

The dishwasher 10 further comprises at a liquid spraying system 36 for introducing, recirculating, and spraying liquid throughout the wash chamber 24. The liquid spraying system 36 is well known and may include components such as a rotatable spray arm 38 positioned beneath the lower utensil rack 32. The dishwasher 10 may further comprise other conventional components such as additional spray arms or nozzles, a sump, a recirculation or drain pump, a heating unit, a filter etc.; however, these components are not germane to the present invention and will not be described further herein.

Figure 2:
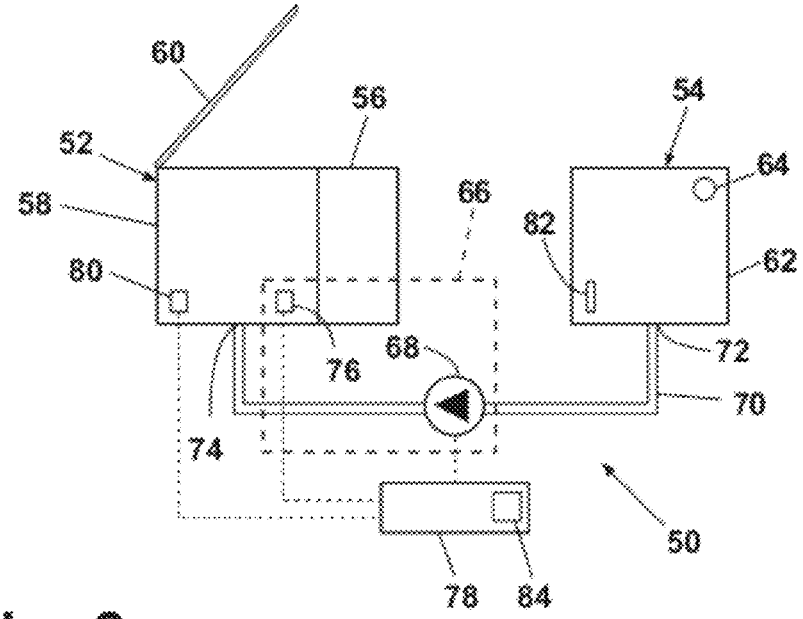
FIG. 2 is a schematic illustration of the door and dispensing system from FIG. 1.

Referring to FIGS. 1 and 2, the dispensing system 50 is carried by the door 26 and comprises a single use dispenser 52 configured to store a single dose of wash aid and a bulk dispenser 54 configured to store multiple doses of wash aid. As used herein, the term "single dose of wash aid", and variations thereof, refers of an amount or volume of wash aid sufficient for one cleaning cycle of the dishwasher 10. The amount or volume of the wash aid may vary depending on the selected wash cycle, but only enough for one cycle is used. As used herein, the term "multiple doses of wash aid", and variations thereof, refers to an amount of wash aid sufficient for multiple cleaning cycles of the dishwasher 10. As used herein, the term "cleaning cycle" refers to one operational cycle of the dishwasher 10 that cleans a load of utensils.

The dishwasher 10 can further comprise a controller 78, which is operably coupled to various components of the dishwasher 10 to implement a cleaning cycle. The dishwasher 10 can be preprogrammed with a number of different cleaning cycles from which a user may select one cleaning cycle to clean a load of utensils. Examples of cleaning cycles include normal, light/china, heavy/pots and pans, and rinse only. A control panel or user interface 84 coupled to the controller 78 may be used to select a cleaning cycle and can be provided on the dishwasher 10. The user interface 84 can be provided on the outer panel 28 of the door 26 and can comprise operational controls such as dials, lights, switches, and displays enabling a user to input commands to the controller 78 and receive information about the selected cleaning cycle. Alternately, the cleaning cycle may be automatically selected by the controller 78 based on soil levels sensed by the dishwasher 10 to optimize the cleaning performance of the dishwasher 10 for a particular load of utensils.

Referring to FIG. 2, the bulk dispenser 54 is fluidly coupled to the single use dispenser 52 to deliver or dispense wash aid to the wash chamber 24 through the single use dispenser 52. A user may elect to dispense wash aid to the wash chamber 24 directly from the single use dispenser 52 by manually supplying a single dose of wash aid to the single use dispenser 52 from an external supply of wash aid, or may alternately elect to dispense wash aid indirectly from the single use dispenser 52 by manually or automatically supplying a single dose of wash aid from the bulk dispenser 54 to the single use dispenser 52. The single use and bulk dispensers 52, 54 can be configured to dispense any type of wash aid, such as, but not limited to, a detergent, a pre-wash detergent, a rinse aid, or bleach, including wash aid in either liquid or powder form.

As illustrated herein, the dispensing system 50 can further comprise a separate rinse aid dispenser 56 for dispensing rinse aid to the wash chamber 24 at an appropriate time during the cleaning cycle and can be configured to receive a single dose or multiple doses of rinse aid. However, the single use and bulk dispensers 52, 54 may also be used to dispense rinse aid to the wash chamber 24.

The single use dispenser 52 can comprise a dispenser found in many present day household dishwashers that delivers or dispenses wash aid to the wash chamber 24 during a cleaning cycle of the dishwasher 10. The single use dispenser 52 can comprise a wash aid cup 58 and a dispenser door 60 is movably mounted to the wash aid cup 58 for movement between an open position, in which the user can manually fill the wash aid cup 58, and a closed position. The single use dispenser 52 can be positioned on the inner panel 30 of the door 26 so that the wash aid cup 58 can be manually supplied with wash aid when the door 26 is in the open position. The location of the single use dispenser 52 on the door 26 can further be optimized to ensure sufficient spray from the liquid spraying system 36 is received to flush out all of the wash aid from the single use dispenser 52. Alternately, the single use dispenser 52 can be positioned elsewhere on the dishwasher 10 so that the wash aid cup 58 can be manually supplied with wash aid when the door 26 is in the closed position.

The bulk dispenser 54 can comprise a bulk supply reservoir 62 that is sized to store multiple doses of wash aid. The bulk supply reservoir 62 can be positioned between the outer and inner panels 28, 30 of the door 26 and can be provided with an opening covered by a removable cap 64 for refilling the bulk supply reservoir 62 with wash aid. The cap 64 can be accessible through the inner panel 30 so that the bulk supply reservoir 62 can be filled when the door 26 is in the open position. Alternately, the cap 64 can be positioned elsewhere so that the bulk supply reservoir 62 may be filled when the door 26 is closed.

The bulk dispenser 54 can further be provided with a fill indicator 82 that communicates the amount of wash aid within the bulk supply reservoir 62 to the user. The fill indicator 82 can comprise any combination of visible or audible indication. The fill indicator 82 can simply comprise a window in the bulk supply reservoir 62 or in the door 26 that allows the user to view the contents of the bulk dispenser 54 and to visually determine when the bulk dispenser 54 requires filling. The fill indicator 82 can alternately comprise a float-type indicator, a light-type indicator, or an alarm-type indicator, all of which are known in the dishwasher art.

The bulk dispenser 54 is not limited to the embodiment shown in the drawings. For example, the bulk dispenser 54 can comprise a removable container that is secured to the door 26 by a suitable locking or latching arrangement. Further, the bulk dispenser 54 can comprise a disposable container rather than a refillable reservoir. The bulk dispenser 54 can further be positioned elsewhere on the dishwasher 10, such as on the surface of the inner panel 30 or within the wash chamber 24.

The dispensing system 50 can further comprise a user-actuable wash aid meter 66 that fluidly couples the bulk dispenser 54 to the single use dispenser 52 to enable the user to supply wash aid to the single use dispenser 52 from the bulk dispenser 54. The wash aid meter 66 can be configured to dispense a predetermined amount of wash aid each cleaning cycle, or the amount can be set or determined by the user prior to each cleaning cycle.

As illustrated, the wash aid meter 66 comprises a pump 68 that transfers wash aid from the bulk dispenser 54 to the single use dispenser 52 through a conduit 70. The conduit 70 has an inlet end 72 in fluid communication with the bulk supply reservoir 62 to receive wash aid from the bulk dispenser 54 and an outlet end 74 in fluid communication with the wash aid cup 58 to deliver wash aid to the single use dispenser 52. The pump 68 can be manually controlled by the user, automatically controlled based on the cleaning cycle, or can be controlled by a combination of both. The pump 68 can transfer predetermined amounts of wash aid that is dependent on the selected cleaning cycle. The pump 68 can comprise a manual-type pump or an automatic-type pump. Other suitable wash aid meters 66 include one or more valves suitable for use in conjunction with a gravity-assisted discharge of wash aid from the bulk dispenser 54 to the single use dispenser 52.

The wash aid meter 66 further comprises an actuator 76 for controlling the operation of the pump 68. The actuator 76 can be provided in a location that is easily accessible to the user. As illustrated, the actuator 76 is provided on the single use dispenser 52. Other suitable locations include the control panel or user interface that is commonly provided on household dishwashers to control the operation of the dishwasher.

The dishwasher 10 further comprises a controller 78 for implementing the selected cleaning cycle of the dishwasher 10. The controller 78 is operably coupled to the bulk dispenser 54 for dispensing wash aid to the single use dispenser 52 during the cleaning cycle. The controller 78 can be further operably coupled to the single use dispenser 52 for controlling the dispensing of wash aid to the wash chamber 24.

In the illustrated embodiment, the controller 78 is also operably coupled to the wash aid meter 66 for controlling the dispensing of wash aid from the bulk dispenser 54 to the single use dispenser 52. However, because the user has the option of manually filling the single use dispenser 52, the dishwasher 10 can be provided with means for detecting whether the user has already filled the single use dispenser 52 before filling it from the bulk dispenser 54. The means can comprise a sensor 80 operably coupled to the controller 78 to communicate to the controller 78 whether wash aid should be automatically supplied by the bulk dispenser 54.

In one embodiment, the sensor 80 can be configured to detecting the presence of wash aid in the single use dispenser 52. When the presence of wash aid is detected in the single use dispenser 52 at the initiation of a cleaning cycle, i.e. when the user has manually supplied wash aid to the single use dispenser 52, wash aid will not be automatically supplied by the bulk dispenser 54. When the presence of wash aid is not detected, the controller 78 will effect the automatic supply of wash aid from the bulk dispenser 54 to the wash chamber 24 through the single use dispenser 52. The controller 78 can be configured to automatically effect the dispensing of wash aid from the bulk dispenser 54 at an appropriate time during the cleaning cycle and in an appropriate quantity based on the selected cleaning cycle. If no wash aid is present in the bulk dispenser 54, an indication such as a visual or audible alarm, that the bulk dispenser 54 is empty, can be communicated to the user.

In another embodiment, the sensor 80 can be configured to detect whether the dispensing door 60 is open or closed at the start of a cleaning cycle. For example, a switch can be integrated into a latch for the dispensing door 60, wherein the switch is open or closed based on the position of the dispensing door 60. If the dispensing door 60 is closed, i.e. the switch is closed, then wash aid will not be supplied from the bulk dispenser 54 and the controller 78 will operate to open the dispensing door 60 at an appropriate time during the cleaning cycle to discharge the wash aid from the single use dispenser 52 into the wash chamber 24. If the dispensing door 60 is left open, i.e. the switch is open, then wash aid will be supplied from the bulk dispenser 54 to the wash chamber 24 through the single use dispenser 52.

In yet another embodiment, the user interface 84 of the dishwasher 10 can be provided with suitable controls for selecting to manually fill the single use dispenser 52 or to automatically fill it from the bulk dispenser 54. If the user selects a "single use" control on the user interface 84, the controller 78 will expect that the user will fill the single use dispenser 52 manually. If the user does not select the "single use" control, then the default operation of the dishwasher 10 is to automatically fill the single use dispenser 52 from the bulk dispenser 54. Alternately, the user interface 84 can be provided with an "automatic" control that the user will select in order for the dishwasher 10 to automatically fill the single use dispenser 52 from the bulk dispenser 54.

In still another embodiment, depressing the actuator 76 can override the automatic dispensing function for a single cleaning cycle. When the actuator 76 is not depressed prior to the initiation of a cleaning cycle, the controller 78 will automatically actuate the pump 68 to supply wash aid from the bulk dispenser 54 at an appropriate time during the cleaning cycle. However, because the user can manually fill the single use dispenser 52 without depressing the actuator 76, means can be provided for communicating to the controller 78 that the user has already manually filled the single use dispenser 52 prior to the initiation of a cleaning cycle. The means can comprise a suitable control provided on the control panel or user interface of the dishwasher 10 that the user can select if the user desires to manually fill the single use dispenser 52 or a sensor in the single use dispenser 52 similar to the sensor 80.

Figure 3:
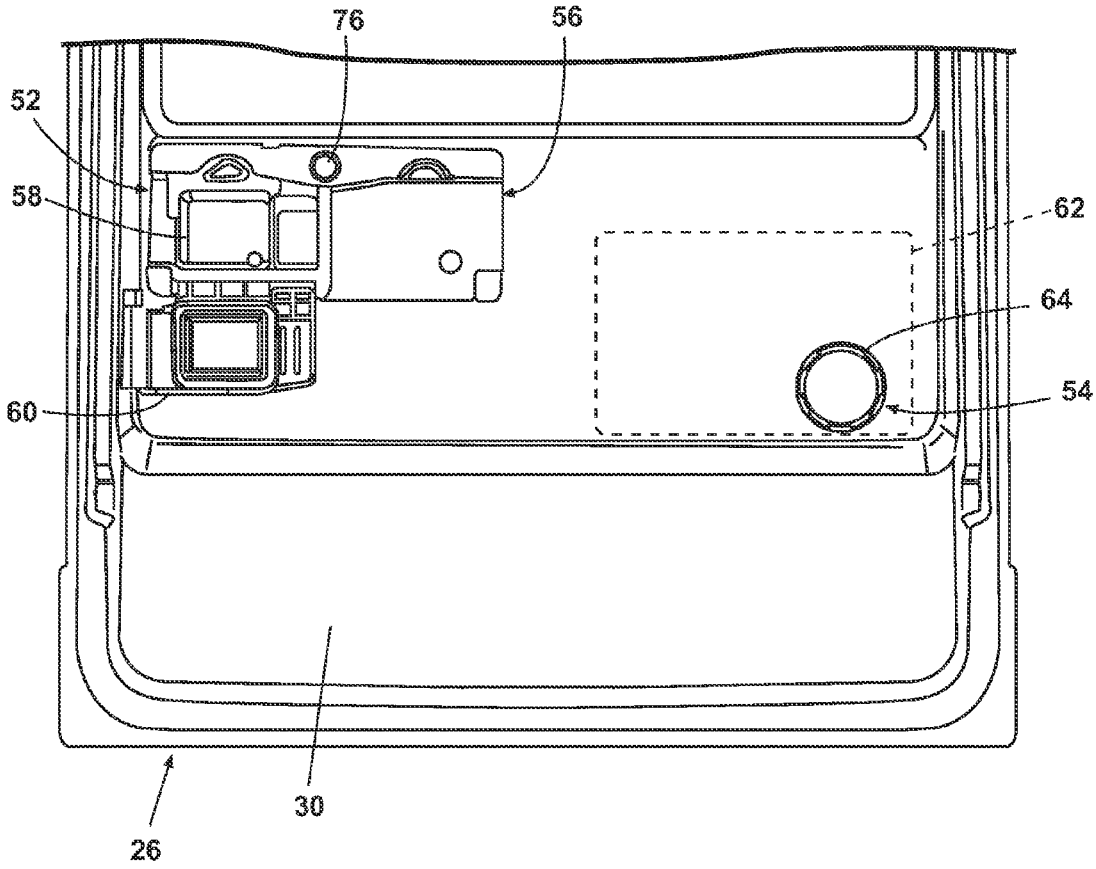
FIG. 3 is a plan view of a dishwasher door and dispensing system according to one contemplated implementation of the invention.

FIG. 3 is a plan view of a dishwasher door 26 comprise the dispensing system 50 according to one contemplated implementation of the invention. In the embodiment illustrated in FIG. 3, the pump 68 (FIG. 2) comprises a manual-type pump and the actuator 76 comprises a push button provided on the single use dispenser 52. Depressing the push button 76 manually pumps wash aid into the wash aid cup 58. This can be done with the dispensing door 60 in the open position so that the user can see the amount of wash aid in the wash aid cup 58. Each complete depression of the push button 76 can pump a predetermined amount of wash aid into the wash aid cup 58. A partial depression of the push button 78 can pump less. The dispensing system 50 can be configured such that a single depression of the push button 76 fills the wash aid cup 58 with a sufficient amount of wash aid for a cleaning cycle, or the dispensing system 50 can be configured such that multiple depressions of the push button 76 are required to fill the wash aid cup 58 sufficiently. The latter offers more control to the user, whereby the user can fill the wash aid cup to a desired level based on their individual preferences based on the number of times the user depresses the push button 76. After the user is satisfied with the amount of wash aid in the wash aid cup 58, the dispensing door 60 is closed. As discussed above, closing the dispensing door 60 can signal to the controller 78 (FIG. 2) that the single use dispenser 52 has been manually supplied with wash aid.

The dispensing system 50 of the present invention offers many benefits to consumers, including the flexibility of providing fully automated bulk dispensing with the option of manual filling. The dispensing system 50 eliminates the need for the user to remove a supply of wash aid from a storage space, fill a dispenser, and replace the supply of wash aid each time the dishwasher is operated; however, the user is given the option of doing so when they desire. The dispensing system 50 further allows the user to maintain precise control over the amount of wash aid dispensed. Furthermore, utilization of the single use dispenser 52 as the entrance point of wash aid from the bulk dispenser 54 into the wash chamber 24 in beneficial as the location of the single use dispenser 52 can be optimized to ensure sufficient spray from the liquid spraying system 36 is received to flush out all of the wash aid from the single use dispenser 52.

While the invention has been specifically described in connection with certain specific embodiments thereof, it is to be understood that this is by way of illustration and not of limitation. For example, while the household dishwasher 10 shown in the figures has only one single use dispenser and one bulk dispenser, the dispensing system 50 can have a greater number of dispensers. It is further understood that the household dishwasher 10 shown in the figures can be operated in accordance with methods other than those described herein. Reasonable variation and modification are possible within the scope of the forgoing disclosure and drawings without departing from the spirit of the invention which is defined in the appended claims.

What is claimed is:

1. A dishwasher, comprising:

a housing defining a wash chamber having an open face;

a door movably mounted to the housing for movement between an open position and a closed position for selectively closing the open face;

a dispensing system carried by the door, the dispensing system comprising:

a single use dispenser configured to store a single dose of wash aid;

a bulk dispenser configured to store multiple doses of wash aid and fluidly coupled to the single use dispenser to dispense wash aid through the single use dispenser; and a sensor positioned within the dishwasher and detecting the presence of wash aid in the single use dispenser; and a controller configured to implement a cleaning cycle of the dishwasher and operably coupled to the bulk dispenser for dispensing wash aid to the single use dispenser during the cleaning cycle, wherein the controller operates to dispense wash aid from the bulk dispenser when wash aid is not detected in the single use dispenser;

wherein a wash aid may be dispensed into the wash chamber directly from the single use dispenser or indirectly from the bulk dispenser through the single use dispenser.

2. The dishwasher according to claim 1, and further comprising a user-actuable wash aid meter fluidly coupling the bulk dispenser to the single use dispenser to permit a user to fill the single use dispenser from the bulk dispenser.

3. The dishwasher according to claim 2 where the user-actuable wash aid meter comprises a pump for pumping the wash aid from the bulk dispenser to the single use dispenser.

4. The dishwasher according to claim 3 wherein the user-actuable wash aid meter further comprises an actuator for controlling the operation of the pump.

5. The dishwasher according to claim 4 wherein the actuator is located on the single use dispenser.

6. The dishwasher according to claim 4 wherein the actuator comprises a push button operably coupled to the pump for controlling the operation of the pump, wherein manual depression of the push button pumps wash aid from the bulk dispenser to the single use dispenser.

7. The dishwasher according to claim 1 wherein the controller is further operably coupled to the single use dispenser for dispensing wash aid to the wash chamber during the cleaning cycle.

8. The dishwasher according to claim 1 wherein the single use dispenser comprises a wash aid cup and the bulk dispenser is fluidly coupled to the wash aid cup.

9. The dishwasher according to claim 8 further comprising a wash aid meter fluidly coupling the bulk dispenser to the wash aid cup to control the amount of wash aid dispensed from the bulk dispenser to the wash aid cup.

10. The dishwasher according to claim 9 wherein the wash aid meter is a user-actuable wash aid meter.

11. The dishwasher according to claim 10 wherein the user-actuable wash aid meter comprises a manual pump.

12. The dishwasher according to claim 8 wherein the single use dispenser further comprises a dispensing door selectively covering the wash aid cup and movable between an open position and a closed position.

13. The dishwasher according to claim 12 wherein the sensor is operably coupled to the door to detect the position of the dispensing door.

14. The dishwasher according to claim 13 wherein the controller is operably coupled to the dispensing door and configured to control the dispensing of wash aid from the bulk dispenser when the dispensing door is detected in the open position.

15. The dishwasher according to claim 1 wherein the dispensing system further comprises a rinse aid dispenser.

16. The dishwasher according to claim 1 wherein the bulk dispenser comprises a bulk supply reservoir for storing the multiple doses of wash aid.

17. The dishwasher according to claim 16, and further comprising an indicator for communicating the amount of wash aid within the bulk supply reservoir to the user.

* * * * *